US008827418B2

(12) United States Patent
Hamasaki et al.

(10) Patent No.: US 8,827,418 B2
(45) Date of Patent: Sep. 9, 2014

(54) INKJET PRINTING APPARATUS

(75) Inventors: Yuji Hamasaki, Kawasaki (JP); Susumu Hirosawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 277 days.

(21) Appl. No.: 11/844,792

(22) Filed: Aug. 24, 2007

(65) Prior Publication Data

US 2008/0055357 A1 Mar. 6, 2008

(30) Foreign Application Priority Data

Aug. 31, 2006 (JP) ..... 2006-236381

(51) Int. Cl.
*B41J 2/165* (2006.01)

(52) U.S. Cl.
CPC ..... *B41J 2/16532* (2013.01)
USPC ..... 347/30

(58) Field of Classification Search
None
See application file for complete search history.

(56) References Cited

U.S. PATENT DOCUMENTS

| | | | | |
|---|---|---|---|---|
| 4,123,761 | A * | 10/1978 | Kimura et al. | 347/30 |
| 5,640,181 | A * | 6/1997 | Uchida et al. | 347/30 |
| 6,364,449 | B1 * | 4/2002 | Takahashi et al. | 347/30 |
| 6,854,826 | B2 * | 2/2005 | Kanda et al. | 347/29 |
| 7,185,970 | B2 | 3/2007 | Hamasaki | |
| 7,246,874 | B2 * | 7/2007 | Hirakata et al. | 347/29 |
| 2002/0060712 | A1 * | 5/2002 | Sugimoto et al. | 347/30 |
| 2002/0060713 | A1 * | 5/2002 | Katakura et al. | 347/30 |
| 2003/0210295 | A1 * | 11/2003 | Mitsuzawa et al. | 347/23 |
| 2005/0041060 | A1 * | 2/2005 | Taniguchi | 347/30 |
| 2006/0221121 | A1 * | 10/2006 | Ide et al. | 347/29 |

FOREIGN PATENT DOCUMENTS

| | | | |
|---|---|---|---|
| JP | 9-323432 | | 12/1997 |
| JP | 10-211720 | A | 8/1998 |
| JP | 2000-52568 | | 2/2000 |
| JP | 2002-200777 | A | 7/2002 |
| JP | 2004-034513 | A | 2/2004 |
| JP | 2005-225214 | A | 8/2005 |
| JP | 2005-313514 | A | 11/2005 |
| JP | 2006-076192 | A | 3/2006 |
| JP | 2006-198846 | A | 8/2006 |

OTHER PUBLICATIONS

Japanese Office Action dated Jul. 1, 2011, issued in corresponding Japanese patent application No. 2006-236381.
Office Action issued in Japanese Patent Office Application No. 2006-236381 on Dec. 16, 2011.

* cited by examiner

*Primary Examiner* — Alejandro Valencia
(74) *Attorney, Agent, or Firm* — Fitzpatrick, Cella, Harper & Scinto

(57) ABSTRACT

An ink jet printing apparatus includes a print head having an ejection port surface with ejection ports formed therein from which ink is ejected, a cap covering the ejection port surface of the print head, and a suction unit for allowing a pump to generate negative pressure in the cap to suck ink from the print head. The suction unit has a valve provided in a communication tube joining the pump and the cap together. The suction unit sucks ink under a relatively low negative pressure and then switches the valve to suck the ink under a relatively high negative pressure.

21 Claims, 15 Drawing Sheets

| | PARAMETER TABLE | | | | | |
|---|---|---|---|---|---|---|
| PRIORITY | FLAG | SUCTION STEP (1) | N TIMES | SUCTION STEP (2) | N TIMES | PRELIMINARY EJECTION (3) |
| HIGH | CLEANING 8 | SUCTION R | 1 | SUCTION B | 2 | PRELIMINARY EJECTION 2 |
| ↑ | CLEANING 7 | SUCTION A | 1 | SUCTION B | 2 | PRELIMINARY EJECTION 2 |
| | CLEANING 6 | SUCTION A | 1 | SUCTION B | 2 | PRELIMINARY EJECTION 2 |
| | CLEANING 5 | SUCTION A | 1 | SUCTION B | 2 | PRELIMINARY EJECTION 2 |
| | CLEANING 4 | SUCTION A | 1 | SUCTION B | 2 | PRELIMINARY EJECTION 2 |
| | CLEANING 3 | SUCTION A | 1 | SUCTION B | 2 | PRELIMINARY EJECTION 2 |
| ↓ | CLEANING 2 | SUCTION A | 1 | SUCTION B | 1 | PRELIMINARY EJECTION 1 |
| LOW | CLEANING 1 | SUCTION A | 0 | SUCTION C | 2 | PRELIMINARY EJECTION 1 |

FIG.9

| NAME | | COL. LARGE PRELIMINARY ELECTION NUMBER | COL. MEDIUM PRELIMINARY EJECTION NUMBER | COL. SMALL PRELIMINARY EJECTION NUMBER | TIMING (EXAMPLE) |
|---|---|---|---|---|---|
| PRELIMINARY EJECTION 1 | PRELIMINARY EJECTION NUMBER | 1000<br>2000<br>0<br>1000<br>2000 | 0<br>0<br>0<br>0<br>0 | 0<br>0<br>0<br>0<br>0 | AFTER SUCTION (CLEANING 1, 2) |
| | DRIVING MODE | SEE PRELIMINARY EJECTION ORDER | | | |
| PRELIMINARY EJECTION 2 | PRELIMINARY EJECTION NUMBER | 1000<br>2000<br>500<br>1000<br>2000 | 0<br>0<br>0<br>0<br>0 | 0<br>0<br>0<br>0<br>0 | AFTER SUCTION (CLEANING 3 AND 4) |
| | DRIVING MODE | SEE PRELIMINARY EJECTION ORDER | | | |
| PRELIMINARY EJECTION 3 | PRELIMINARY EJECTION NUMBER | 5000<br>0<br>0<br>0<br>0 | 5000<br>0<br>0<br>0<br>0 | 5000<br>0<br>0<br>0<br>0 | DURING LOW-LEVEL IDLE SUCTION |
| | DRIVING MODE | SEE PRELIMINARY EJECTION ORDER | | | |
| PRELIMINARY EJECTION 4 | PRELIMINARY EJECTION NUMBER | 0<br>0<br>0<br>0<br>0 | 300<br>0<br>0<br>0<br>0 | 300<br>0<br>0<br>0<br>0 | AFTER PRELIMINARY EJECTIONS 1 TO 3 |
| | DRIVING MODE | SEE PRELIMINARY EJECTION ORDER | | | |
| PRELIMINARY EJECTION 5 | PRELIMINARY EJECTION NUMBER | 15<br>0<br>0<br>0<br>0 | 35<br>0<br>0<br>0<br>0 | 35<br>0<br>0<br>0<br>0 | DURING PRINTING |
| | DRIVING MODE | SEE PRELIMINARY EJECTION ORDER | | | |
| PRELIMINARY EJECTION 6 | PRELIMINARY EJECTION NUMBER | 200<br>0<br>0<br>0<br>0 | 100<br>0<br>0<br>0<br>0 | 100<br>0<br>0<br>0<br>0 | AFTER WIPING |
| | DRIVING MODE | SEE PRELIMINARY EJECTION ORDER | | | |

FIG.11

INKJET PRINTING APPARATUS

BACKGROUND OF THE INVENTION

1. Field of the Invention

The present invention relates to an ink jet printing apparatus, and in particular, to an ink jet printing apparatus comprising a configuration that performs suction recovery on an ink jet print head.

2. Description of the Related Art

Printing apparatuses provide print output functions for printers, copiers, facsimile machines, and the like and are used as output instruments for composite electronic instruments and workstations including computers, work processors, and the like. The printing apparatuses print images on print media, for example, sheets or thin plastic sheets, on the basis of image information. The printing apparatuses can be classified into an ink jet type, a wire dot type, a thermal type, a laser beam type, and the like according to the printing scheme of the apparatus.

The ink jet printing apparatus uses a print head to eject ink to a print medium for printing. During a continuous operation of ejecting ink from the print head, normal printing may be prevented by dried ink in ink ejection ports in the print head or foreign material attached to the periphery of the ink ejection ports. Some ink jet printing apparatuses allow ink cartridges with ink filled therein to be separated from the print head. The type of ink jet printing apparatus needing only the replacement of the ink cartridge when the ink in that ink cartridge is exhausted requires a process for feeding ink into the print head after a new ink cartridge has been installed. Moreover, parts such as ink paths and ejection ports through which ink flows constitute very small spaces. Bubbles may be collected in paths or communication sections through which ink flows from ink tanks to ink nozzles. The bubbles need to be removed.

Thus, the ink jet printing apparatus comprises a recovery mechanism allowing negative pressure to act on the interior of a cap covering an ejection port surface of the print head to suck and forcibly discharge ink from the print head. This enables dried ink, foreign material, air, and the like to be discharged together with the ink and also allows ink to be introduced after the appropriate ink cartridge gas been replaced. Bubbles in the ink paths and the like can also be discharged. Another known recovery process is an ejection operation unrelated to printing and performed at a predetermined position in the cap (this operation is hereinafter also referred to as preliminary ejection). In this recovery process, waste ink discharged into the cap is accommodated in the cap under the same action as that of the suction.

A known source for negative pressure for the suction recovery process uses a tube pump. The tube pump externally controls a tube using a plastic member and internally has a rotating shaft comprising a roller that rotatably presses the tube. Rotating the rotating shaft rotates the roller in conjunction with the rotating shaft while pressing the tube, to generate negative pressure. The negative pressure reduces the pressure on an ink ejection port surface of the ink jet print head to recover ink suction. To recover suction using the tube pump, the negative pressure in the cap is increased while sucking ink. Thus, before the pressure on the ejection port surface decreases to a desired value, more ink than required may be discharged from the print head.

That is, the amount of ink sucked to fill ink into an ink path 302, an ink common liquid chamber 303 and the like in the print head shown below in FIG. 7 can be easily set. However, the negative pressure in the cap needs to be further increased in order to remove bubbles from very small parts such as the bubbling chamber 308 and the like in the ink ejection nozzle section. Thus, even after the ink is filled into the ink path 302 and the ink common liquid chamber 303 the ink may need to be further sucked.

Another known form of negative pressure source uses a piston pump. For example, a piston is provided in a closed cylinder in tight contact with an inner wall thereof so as to prevent pressure leakage. The piston is then moved to reduce the pressure of the interior of the cylinder. Subsequently, once the piston passes through a hole that is in communication with the ejection portion surface of the ink jet print head, the negative pressure in the cylinder is transmitted to the ink jet print head to recover ink suction.

To perform suction recovery using the piston pump, an initial negative pressure can be set at a large value. That is, the suction pressure required to remove bubbles from very small parts such as the bubbling chamber 308 and the like in the ink ejection nozzle section can be set with comparative ease. However, it is difficult for the piston pump to adjust the amount of ink to be filled into the ink path 302, the ink common liquid chamber 303 and the like owing to the difficulty with which the suction amount is varied as well as a narrow adjustment range. Accordingly, a suction operation for filling ink into the ink path 302, the ink common liquid chamber 303 and the like needs to be performed a number of times to adjust the suction amount.

As describe above, the above pump fails to optimization the suction recovery for filling ink into the ink path 302, the ink common liquid chamber 303 and the like, and the suction recovery for removing bubbles from the bubbling chamber 308 and the like in the ink ejection nozzle section. That is, the problem of reduction of the amount of sucked while maintaining the reliability of a print head remains.

In contrast, Japanese Patent Laid-Open No. 09-323432 discloses a recovery process using a tube pump wherein a valve is placed in a configuration for suction recovery to increase the negative pressure. Japanese Patent Laid-Open No. 2000-52568 discloses a recovery process also using a tube pump wherein a valve is placed in a configuration for suction recovery to increase the negative pressure, enabling two-step suction.

According to the recovery process described in Japanese Patent Laid-Open No. 09-323432, the valve is placed in the configuration for recovery to increase the negative pressure, so that a high negative pressure acts rapidly to increase the speed at which ink is discharged, enabling bubbles to be removed from the ink paths and the like. However, the high negative pressure dose not enable to be kept for a long time, the suction for removing bubbles under the high negative pressure dose not enable to be apply to the ink suction for filling ink into the print head. Further, if two-step suction is performed first under a low pressure and then under an increased pressure using the recovery process described in Japanese Patent Laid-Open No. 2000-52568, the pump operates even during the pressure switching operation, preventing a reduction in the amount of ink sucked.

SUMMARY OF THE INVENTION

An object of the present invention is to provide an ink jet printing apparatus having a suction recovery function, the apparatus comprising a pump enabling suction recovery that recovers the reliability of a print head while reducing the amount of ink sucked from the print head.

To accomplish the object, the present invention provides an ink jet printing apparatus for printing by using a print head having an ejection port surface in which ejection ports for ejecting ink are formed, said apparatus comprising: a cap that covers the ejection port surface of the print head, and a suction means that is provided with a tube in communication with the cap and a pump which presses the tube, said suction means sucking ink from the print head by generating negative pressure in the cap by the pressing of the pump, wherein the suction means has a valve that is able to block the communication between a portions of the tube pressed by the pump and the cap, and sucks ink under a relatively low negative pressure and then sucks ink under a relatively high negative pressure using the valve.

The present invention provides the ink suction under the relatively low pressure is performed by driving the pump with a condition where the valve is opened, and the ink suction under the relatively high negative pressure is performed by driving the pump with a blocked condition where the valve is closed to generate the negative pressure, then stopping driving the pump, and subsequently opening the valve to release the blocked condition.

The above configuration enables suction recovery that that recovers the reliability of a print head while reducing the amount of ink sucked from the print head.

Further features of the present invention will become apparent from the following description of exemplary embodiments (with reference to the attached drawings).

BRIEF DESCRIPTION OF THE DRAWINGS

FIG. 9 is a table showing operations in a cleaning mode in accordance with the first embodiment of the present invention;

FIG. 11 is a table showing the number of ejections for preliminary ejection in accordance with the first embodiment of the present invention;

DESCRIPTION OF THE EMBODIMENTS

Embodiments of the present invention will be described below in detail with reference to the drawings.

(First Embodiment)

Figure 1:
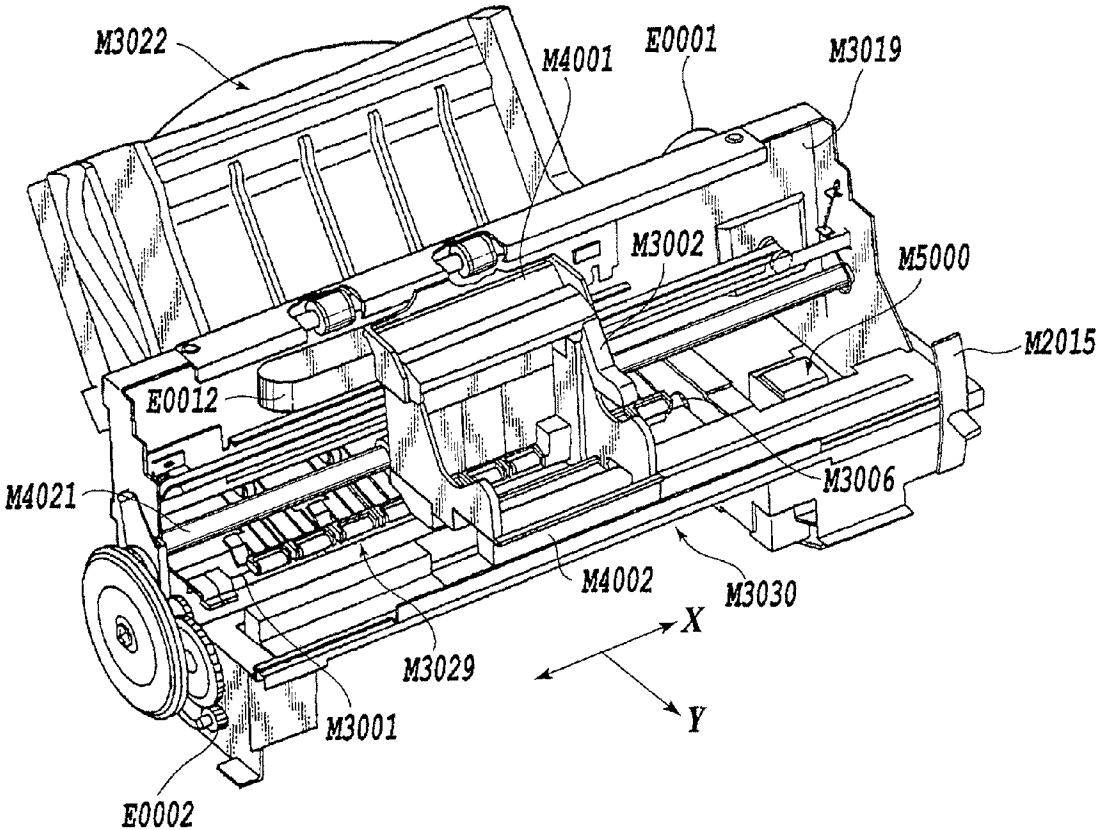
FIG. 1 is a diagram showing an ink jet printing apparatus in accordance with a first embodiment of the present invention.

FIG. 1 is a schematic diagram showing an essential part of an ink jet printing apparatus in accordance with a first embodiment of the present invention. In FIG. 1, a chassis M3019 housed in an armor member of the printing apparatus is composed of a plurality of plate-like metal members having a predetermined rigidity. The chassis M3019 is a core of the printing apparatus. The printing apparatus in accordance with the present embodiment comprises an automatic feeding section M3022, a conveyance section M3029, a discharge section M3030, and a recovery section M5000. The automatic feeding section M3022 automatically feeds sheets (print media) to the interior of an apparatus main body. The conveyance section M3029 guides a sheet fed by the automatic feeding section M3022 to a predetermined printing position and from the printing position to the discharge section M3030. Arrow Y denotes a direction in which sheets are conveyed (sub-scanning direction). The sheet conveyed to the printing position is subjected to desired printing by a printing section. The printing section uses the recovery section M5000 to execute a recovery process. Reference numeral M2015 denotes a sheet distance adjustment lever. Reference numeral M3006 denotes a bearing of the LF roller M3001. In the printing portion, the carriage M4001 is supported by a carriage shaft M4021 so as to be movable in the direction of arrow X (main scanning direction). An ink jet print head H1001 (see FIG. 3) is releasably mounted on the carriage M4001.

The print head H1001, mounted on the carriage M4001, obtains head driving signals required for printing, from a main circuit board E0001 via a main body flexible board E0012. A print head may be a system which the energy required to eject ink thermal energy generated by electrothermal converters. In this case, the electrothermal converters generate heat to subject the ink to film boiling so that the resulting bubbling energy enables the ink to be ejected from ejection ports.

The recovery section M5000 comprises a cap (not shown) that caps an ejection port surface of the print head H1001. A tube pump (not shown) is connected to the cap to introduce negative pressure into the cap. A motor in the tube pump drivingly rotates a holder holding a roller. Negative pressure is introduced into the cap covering the ejection port surface of the print head H1001 to suck and discharge the ink from the ink ejection ports. A suction recovery process is thus executed in order to maintain the appropriate ink ejection state of the print head H1001. Further, to maintain the appropriate ink ejection state of the print head H1001, an ejection recovery process is executed by ejecting ink not contributing to image printing from the ink ejection ports into the cap (this operation is hereinafter referred to as "preliminary ejection").

The carriage M4001 has a carriage cover M4002 at a predetermined installation position on the carriage M4001 to guide the print head H1001. Moreover, the carriage M4001 has a head set lever M4007 that engages with a tank holder of the print head H1001 to set the print head H1001 at the predetermined installation position. The head set lever M4007 is pivotable with respect to a head set lever shaft positioned at the top of the carriage M4001 and has an engagement portion which engages with the print head H1001 and which comprises a spring loaded head set plate (not shown). The spring force of the engagement portion allows the head set lever M4007 to be installed on the carriage M4001 while pressing the print head H1001.

Figure 2:
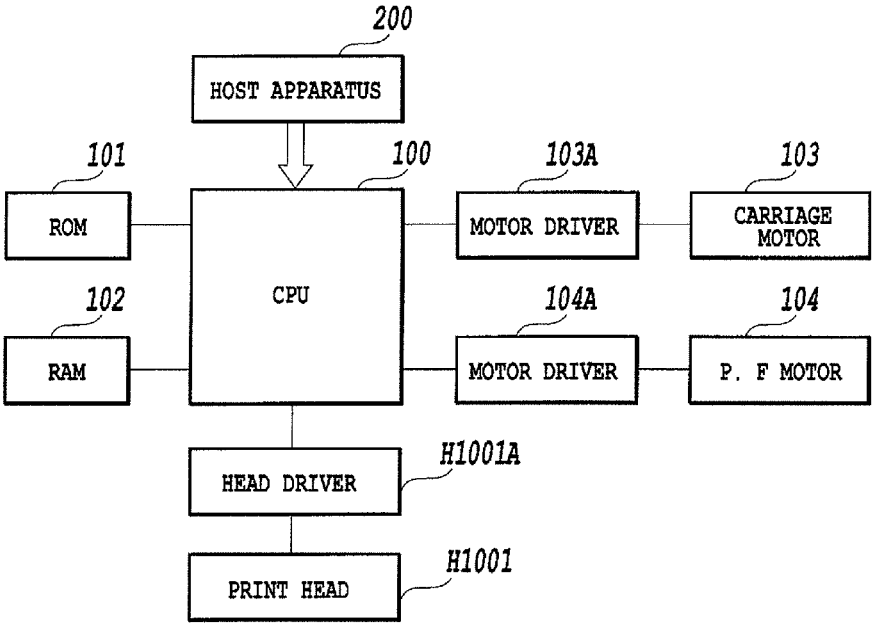
FIG. 2 is a block diagram showing a control system of the printing apparatus in accordance with the first embodiment of the present invention.

FIG. 2 is a block diagram schematically showing a control system for a printing apparatus in accordance with the present embodiment. In FIG. 2, a CPU 100 executes processes of controlling the operation of the apparatus in accordance with the present embodiment, processing data, and the like. A ROM 101 is stored programs of these processes. A RAM 102 is used as, for example, a work area in which these processes are executed. Ink ejection from the print head H1001 is performed by the CPU 100 by supplying driving data (print data) and driving control signals (heat pulse signals) for the thermoelectric converters and the like to the head driver H1001A. The CPU 100 uses a motor driver 103A to control a carriage motor 103 that drives the carriage M001 in the main scanning direction. The CPU 100 uses a motor driver 104A to control a P. F motor 104 that conveys print medium in the sub-scanning direction. For printing, the CPU 100 stores print data transmitted by a host apparatus 200 through an external I/F, in a print buffer. The carriage motor 103 then allows the print head H 1001 to perform scanning in the main scanning direction together with the carriage M4001. The CPU 100 then repeats a printing operation of ejecting ink from the print head H11001 on the basis of print data and a conveying operation of allowing the P. F motor 104 to convey a print medium in the sub-scanning direction, to sequentially print images on the print medium.

The control system described above drivingly controls a tube pump in accordance with an embodiment of the present invention. Specifically, the CPU 100 drivingly controls not only a driving motor for the tube pump but also the cap and wiping in accordance with a process program described below with reference to FIG. 8.

Figure 3:
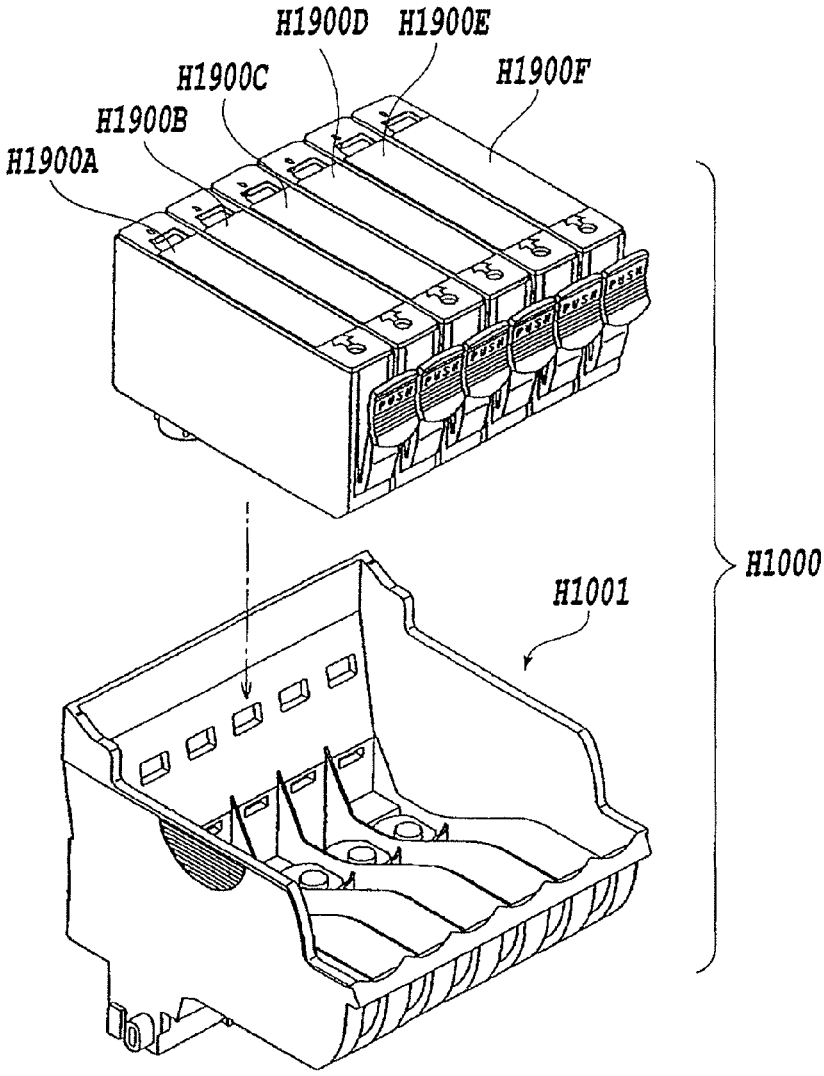
FIG. 3 is a diagram generally showing an ink jet print head and ink tanks in accordance with the first embodiment of the present invention.

FIG. 3 is a diagram showing ink tanks and a print head in accordance with a first embodiment of the present invention. The print head H1001 has ink tanks H1900A to H1900F mounted thereon to constitute a print head cartridge H1000. The printing apparatus in accordance with the present embodiment has independent ink tanks for inks in photo black (Bk), cyan (C), magenta (M), and yellow (Y) in order to enable high-quality photographic printing. C ink is stored in H1900A and H1900F. M ink is stored in H1900B and H1900E. Y ink is stored in H1900C. Bk ink is stored in H1900D. These ink tanks can be freely installed on and removed from the print head H1001. The present embodiment uses photo black, cyan, magenta, and yellow, but the present invention is not limited to these four color inks. The present invention may use at most three of these color inks, a combination of the four color inks with additional inks, or a combination of additional inks and any of the four color inks. The additional inks may be, for example, light cyan, light magenta, light yellow, or pigment black ink.

FIGS. 4, 5, 6, and 7 are diagrams illustrating an ink jet print head shown in FIG. 3 in detail.

Figure 4:
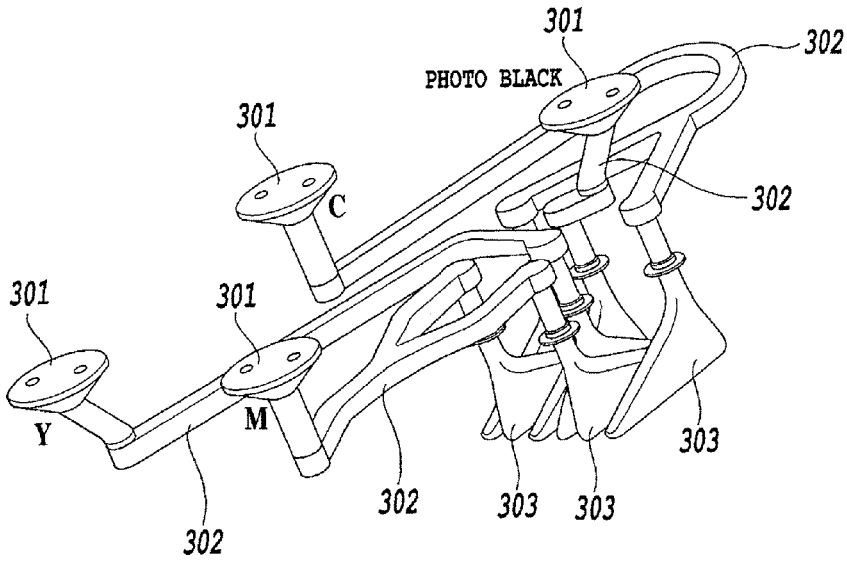
FIG. 4 is a schematic diagram showing ink paths in the ink jet print head in accordance with the first embodiment of the present invention.

FIG. 4 is a schematic diagram showing ink paths in the ink jet print head. The present embodiment has ink paths for the four color inks in cyan, magenta, yellow, and photo black. A filter section 301 has a metal filter thermally soldered to the print head H1001. The filter section 301 is a coupling to the corresponding ink tank and provides a function for generating a capillary force required to feed ink from the ink tank and preventing the entry of dust and dirt from the exterior. An ink path section 302 feeds ink from the filter section 301 to ink nozzles. The ink path section 302 has a cross section of diameter about 1 mm. The diameter of ink path section 302 offers a lower flow resistance than the ink nozzle section but has a volume equal to the most part of that of the corresponding ink path. The ink path is in communication with an ink common liquid chamber 303. The ink common liquid chamber 303 has a width of about 1 mm and is inclined toward a direction in which the ink nozzles are formed in order to remove bubbles. The total volume of the four color inks is about 197 $mm^3$.

Figure 5:
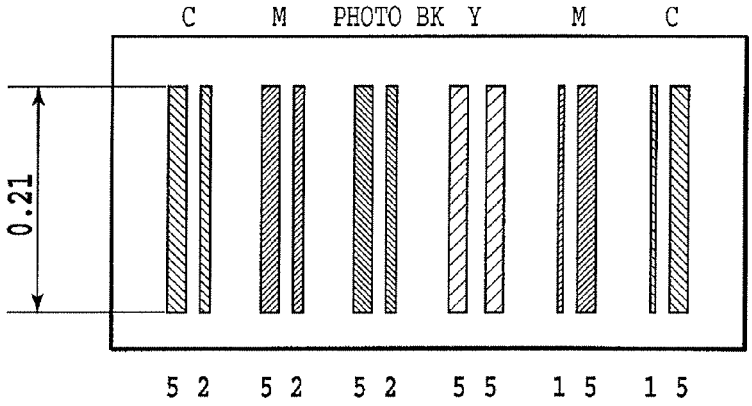
FIG. 5 is a schematic perspective diagram showing ink nozzle lines in the ink jet print head in accordance with the first embodiment of the present invention as viewed from an ink path side.

FIG. 5 is a schematic perspective view of ink nozzle lines as viewed from the ink path side. Two ink nozzle lines are constructed in each common liquid chamber 303. Each of the ink nozzle lines has a length of 0.21 inches. The cyan and magenta nozzle lines have widths corresponding to 5 pl, 1 pl, 2 pl, and 5 pl in this order from the right to left of the figure. The yellow nozzle lines have widths corresponding to 5 pl and 5 pl. The photo black nozzle lines have widths corresponding to 2 pl and 5 pl.

Figure 6:
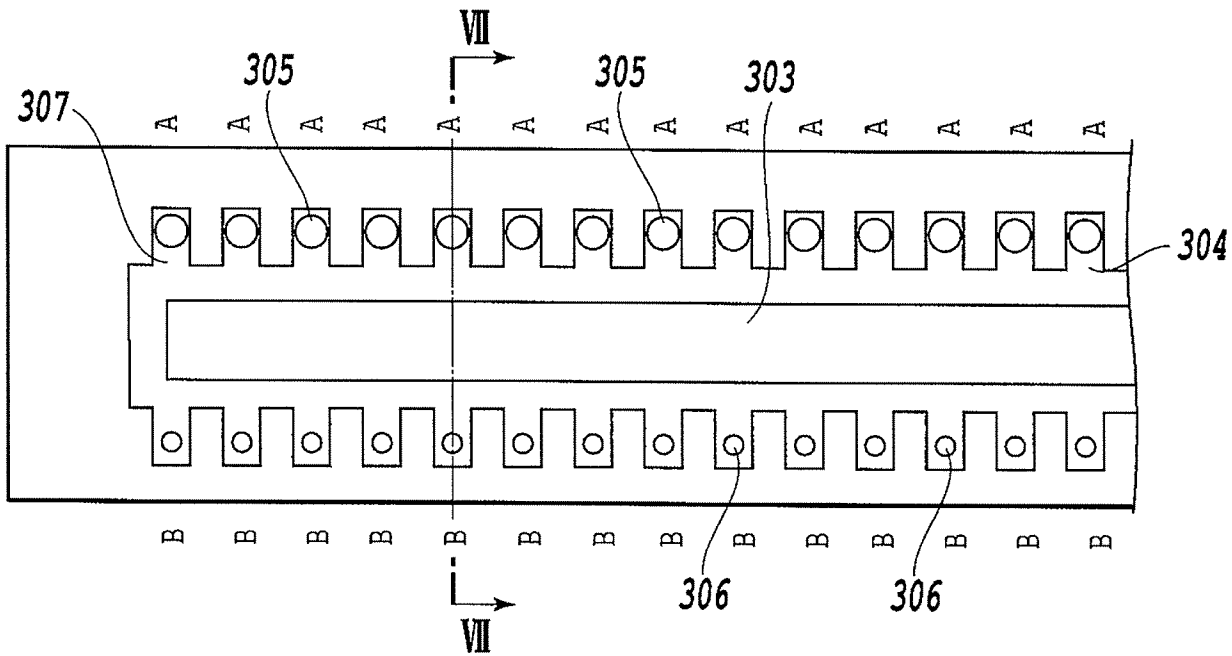
FIG. 6 is a schematic perspective view of the ink nozzle line shown in FIG. 5 as viewed from the ink path side.

FIG. 6 is a schematic diagram corresponding to partly enlarged FIG. 5. Reference numerals 303 and 304 denote a common liquid chamber and an ink bubbling chamber, respectively. Reference numerals 305 and 306 denote a 5-pl ink ejection port and a 1-pl ink ejection port, respectively. Reference numeral 307 denotes an ink introduction section through which ink from the common liquid chamber 303 is introduced.

Figure 7:
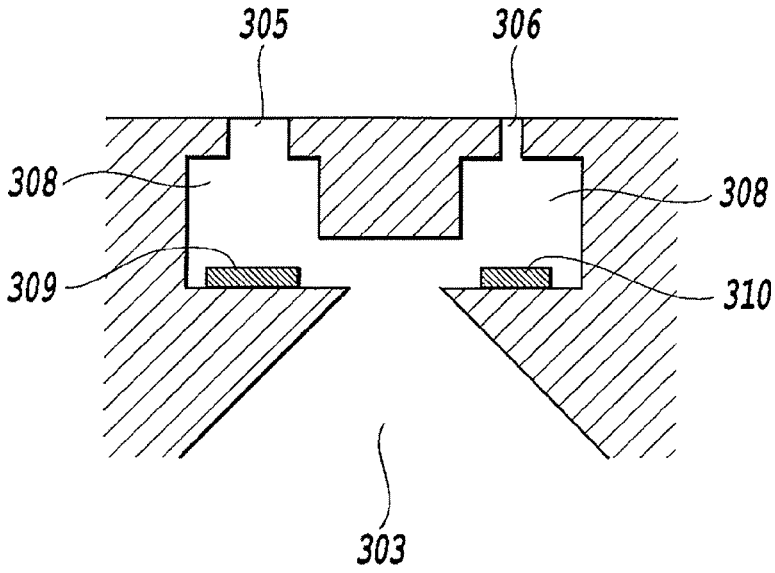
FIG. 7 is a schematic sectional view of the ink nozzle line shown in FIG. 6, the view being taken along dashed line C-C.

FIG. 7 is a schematic diagram showing a cross section taken along line C-C in FIG. 6. Reference numerals 303 and 308 denote a common liquid chamber and an ink bubbling chamber, respectively. Reference numerals 305 and 306 denote a 5-pl ink ejection port and a 1-pl ink ejection port, respectively. Reference numeral 309 denotes a heater (electrothermal varying element) for the 5-pl ink ejection port. Reference numeral 310 denotes a heater (electrothermal varying element) for the 2-pl ink ejection port.

Figure 8:
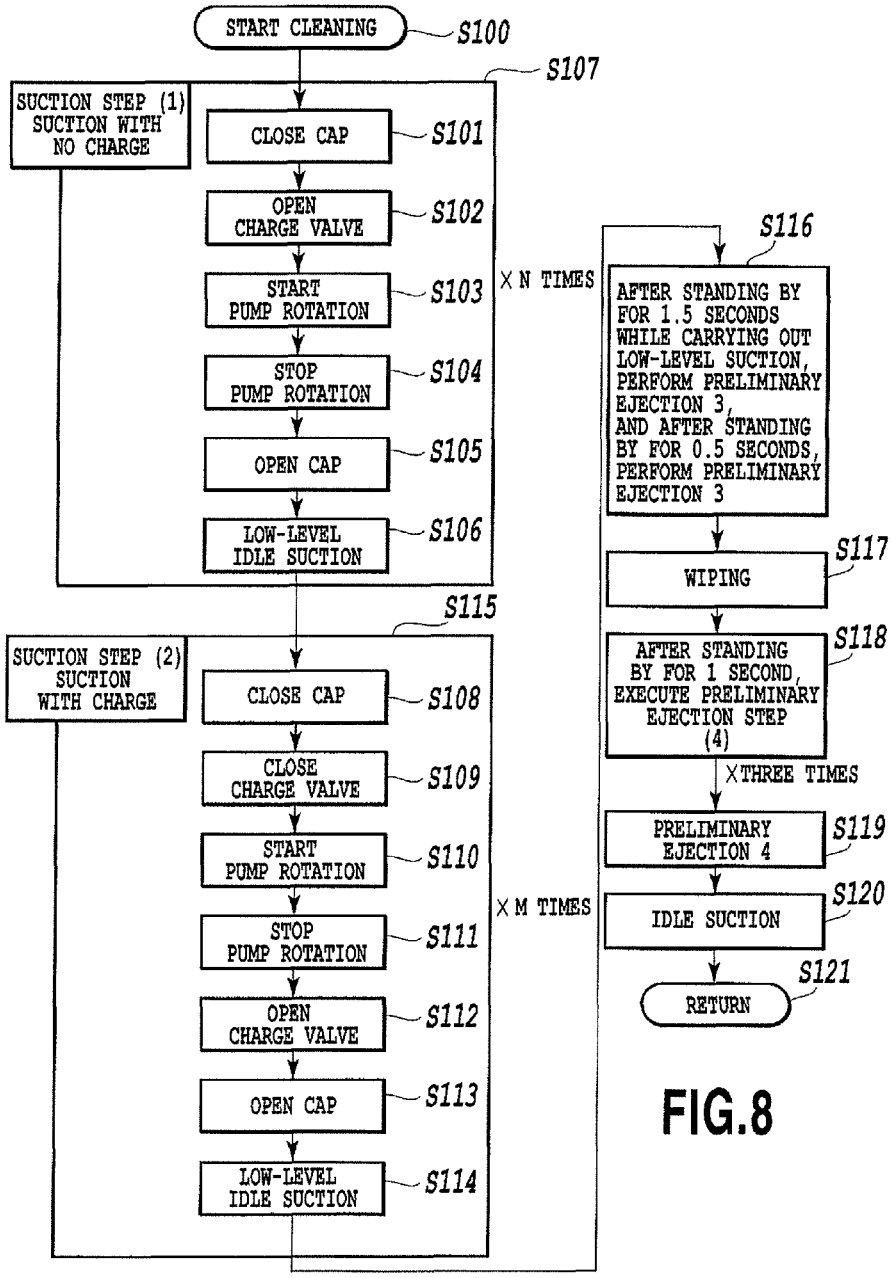
FIG. 8 is a flowchart of the first embodiment of the present invention.

FIG. 8 is a flowchart showing a process for controlling suction recovery in accordance with the first embodiment of the present invention. FIG. 9 is a table showing combinations of suction recovery operations performed by the print head.

The ink jet printing apparatus cleans the print head under suction recovery control in order to remove bubbles from the print head, to discharge sticking ink, or to fill the print head with ink. Cleaning is required when the ink jet print head is installed, when any ink tank is replaced, or when non-printing time exceeds a predetermined period. Further, when a printer driver or the like inputs an instruction to perform cleaning, to the apparatus, the ink jet print head is cleaned immediately or at a predetermined timing.

The type of cleaning varies depending on the application. Cleaning 1 shown in FIG. 9 exhibits the lowest cleaning intensity and corresponds to cleaning performed after the shortest non-printing time has passed or to manual cleaning specified by the printer driver or the like. Cleaning 8 with the highest cleaning intensity corresponds to refresh cleaning that can be specified by the printer driver or the like. The cleaning 8 is used when the ejection state of the ink jet print head cannot be recovered by the manual cleaning.

A suction step (1) is a suction recovery operation not using any charge valve. "Suction R" and "suction A" indicate suctions with different motor rotation numbers. A suction step (2) is a suction recovery operation using a charge valve described below with reference to FIG. 10. "Suction B" indicates a suction operation in which the pump does not operate while the charge valve is open. "Suction C" indicates a suction operation in which the pump operates while the charge valve is open. In the present embodiment, two modes are set for each of steps (1) and (2). However, the present invention is not limited to the above number and types of modes. That is, for step (1), modes other than the "suction R" and "suction A" which involve different motor speeds may be selected or the modes may involve only the motor rotation numbers of the "suction R" and "suction A". For step (2), the number of modes may be increased depending on the timing at which the rotation of the pump is stopped.

The suction recovery step will be described with reference to FIG. 8 taking the case of the cleaning 2, which is specified for ink tank replacement. As shown in FIG. 9, selection of the cleaning 2 selects the "suction A" for the suction step (1), setting the number of suction operations at 1. For preliminary ejection (3), "preliminary ejection 1" is selected.

First, the printing apparatus senses that any of the ink tanks has been replaced. A flag indicating the need for the cleaning 2 is thus set. Then, when a print signal is input to the apparatus or when the printer driver or the like inputs an instruction to perform cleaning, to the apparatus, the cleaning request flag is compared with a cleaning request flag resulting from the replacement of the ink tank. Then, if the cleaning 2 has the highest priority, the cleaning 2 is performed.

Starting cleaning (S100) allows the suction step (1) to be executed (S101 to S106). The cleaning 2 is performed to carry out the suction A in the suction step (1).

First, the cap is pressed against the print head into tight contact with the ejection port surface (S101). Since the suction step (1) performs suction not using any charge valve, the charge valve is opened in S102. Then, in S103, the pump starts rotation.

Figure 10:
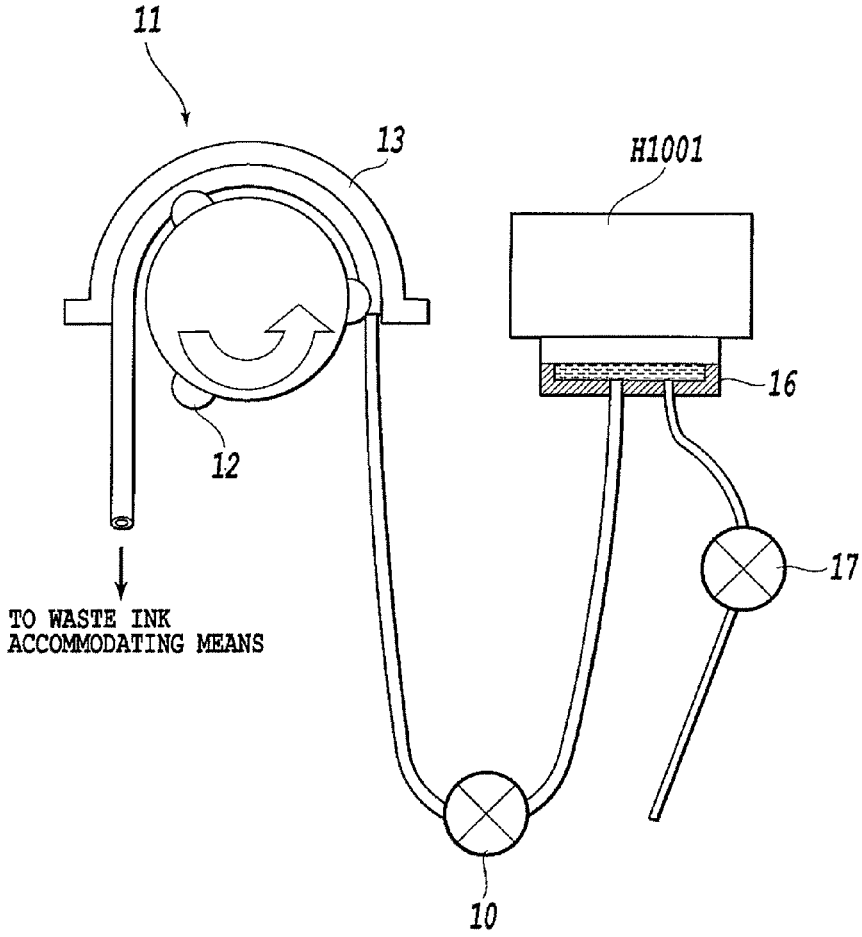
FIG. 10 is a schematic diagram of a charge valve scheme-based recovery system in accordance with the first embodiment of the present invention.

FIG. 10 is a diagram showing the configuration of the charge valve, the charge valve pump, and the print head. Reference numerals 10, 11, and H1001 denote the charge valve, the charge valve pump, and the print head, respectively. The charge valve 10 can block the communication between the charge valve pump 11 and the cap. Closing the charge valve 10 causes the tube to be pressed to block the communication (blocked state). Opening the charge valve 10 cancels the blocked state to return the print head to the communication state. A shaft with a roller 12 placed thereon rotates in the direction of an arrow to sequentially squeeze parts of the tube which are held between a roller 12 and a guide 13. Rotation of the roller 12 generates negative pressure in the tube. As a result, the pressure on the ink jet print head H1001 is reduced through the cap 16 to suck ink from the ink ejection ports. The suction amount is controlled by the predefined rotation number or speed of the roller 12. The suction amount of the "suction A" is about 0.35 cc (the total amount of the four color inks sucked). The maximum pressure during suction (the total negative pressure, that is, the negative pressure generated while ink is flowing) is about −20 kPa.

After the roller rotates by the predetermined rotation number, the pump driving is stopped (S104). The cap is then opened to open the interior of the print head to the atmospheric pressure (S105). Idle suction is subsequently performed to discharge the ink remaining in the cap (S106). Here, in the cap opening (S105), the cap pressed against and in contact with the print head may be separated from the print head to open the print head to the atmospheric pressure or an air open valve 17 may be used to open the print head to the atmospheric pressure without separating the cap from the print head. Using the air open valve 17 to open the print head to the atmospheric pressure prevents the print head from being affected by an internal pressure reduction.

Step 1 is mainly intended to fill ink into the ink path 302 and ink common liquid chamber 303 in the ink jet print head. This is because it is assumed that if any ink tank is to be replaced, the ink in that ink tank has been exhausted and that if printing is continued until printed images are blurred, no ink may remain in the ink paths in the ink jet print head. That is, the first step is not mainly intended to completely remove bubbles from very small parts such as the bubbling chamber 308 and ink introduction section 307 in the ink ejection nozzle section.

The cleaning 2 involves executing the first step once (N=1) (S107) and then executing the second step.

The cap is pressed against the print head into tight contact with the ejection port surface (S108). Since the suction step (2) involves the suction using the charge valve, the charge valve 10 is closed in S109. For the valve scheme, the tube may be mechanically pressed and closed or a solenoid valve may be provided. However, the scheme of mechanically pressing the tube is most preferable in terms of cost and size.

In S110, pump driving is started. At this time, the part extending from the roller 12 for the tube to the charge valve 10 serves as a pressure reduction chamber to charge negative pressure. For the cleaning 2, the "suction B" is selected. In this case, the charge pressure is controlled by the predefined rotation number or speed of the roller.

Then, in S111, the driving of the pump is stopped. In S112, the charge valve is opened to subject the print head to suction. As in the case of S105 and S106, the cap is opened to open the interior of the print head to the atmospheric pressure (S113). Idle suction is performed to discharge the ink remaining in the cap (S114). The suction amount is controlled by the time from opening of the charge valve to the subsequent opening of the cap (Time from S112 to S113). According to the present embodiment, the cap is opened about 0.1 seconds after the charge valve is opened. In this case, the suction amount is about 0.03 cc (the total amount of the four color inks sucked). The maximum pressure during suction (the total negative pressure) is about −35 kPa. In S113, using the air open valve 17 to open the cap to the atmospheric pressure prevents the print head from being affected by an internal pressure reduction.

The cleaning 2 involves executing the above suction step (2) once (M=1) (S115). Thus, in the cleaning 2, on the basis of one suction execution instruction, the suction step (1) under a relatively low negative pressure and the suction step (2) under a relatively high negative pressure are consecutively executed in this order.

Then, preliminary ejection is performed during S116 to S119.

FIG. 11 is a table showing the number of ejections for preliminary ejection. First, in S116, preliminary ejection 3 is performed after standing by for 1.5 seconds while carrying out idle suction. As shown in FIG. 11, all the nozzles, that is, the large nozzles (5 pl), the medium nozzles (2 pl), and the small nozzles (1 pl), are subjected to the preliminary ejection 3; 5,000 droplets are ejected from each nozzle. Then, after 0.5-second standby, the preliminary ejection 3 is performed again.

Then, the ejection port surface is wiped (S117), and the preliminary ejection step (3) is executed (S118). The preliminary ejection step (3) involves "preliminary ejection 1" or "preliminary ejection 2" shown in FIG. 11 (see FIG. 9). That is, the "preliminary ejection 1" is performed when the cleaning 1 or 2 is selected. The "preliminary ejection 2" is performed when any of cleanings 3 to 8 is selected.

Selection of the cleaning 2 allows the "preliminary ejection 1" to be performed. Thus, for all the large nozzles (5 pl), 1,000 droplets, 2,000 droplets, 0 droplet, 1,000 droplets, and 2,000 droplets are ejected in this order in such a manner that different nozzles are selected for each preliminary ejection operation.

Then, the preliminary ejection 4 is performed (S119) All the medium nozzles (2 pl) and the small nozzles (1 pl) are subjected to the preliminary ejection of 300 droplets. Idle suction is performed in S120, and the recovery process is finished in S121.

Figure 12:
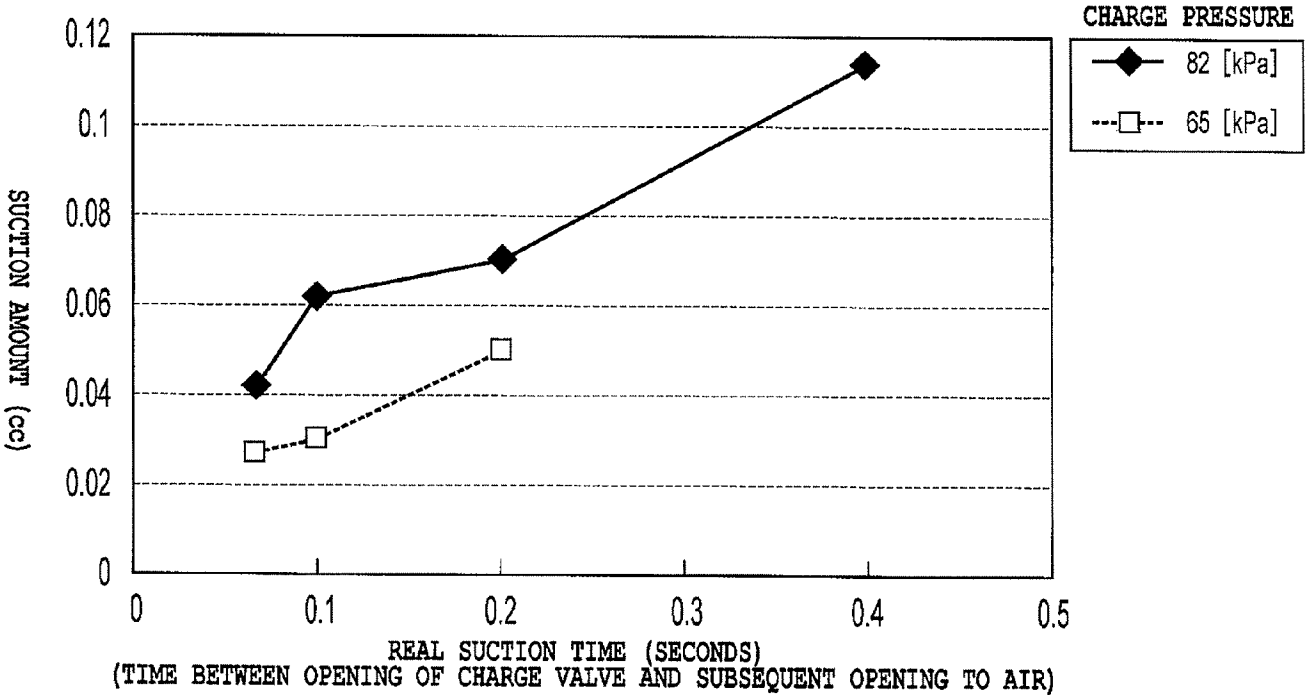
FIG. 12 is a graph showing the relationship between the time when a cap is open for charge suction and the amount of ink sucked in accordance with the first embodiment of the present invention.

FIG. 12 is a graph showing the suction amount and the time between the opening of the charge valve (S112) and the subsequent opening of the cap (S113) during the suction step (2). The suction amount was measured under two types of charge pressure, 65 kPa and 82 kPa, using a real suction time as a parameter.

At a charge pressure of 65 kPa, the suction amount is about 0.03 cc at a real suction time of 0.1 seconds and is about 0.05 cc at a real suction time of 0.2 seconds. In this case, there is no difference in the capability of removing bubbles from very small parts among the ink ejection nozzles. Thus, printing reliability has no problem. It is therefore effective to set the real suction time at 0.1 seconds and the suction amount at 0.03 cc. This is because the maximum suction pressure observed immediately after the opening of the charge valve is most predominant; the subsequently sucked ink does not contribute to the removal of bubbles. If the suction time is shorter than 0.1 seconds, mechanical parts may operate unstably.

Even when the charge pressure is set at 82 kPa and the maximum pressure is set equal to 65 kPa multiplied by about 1.26, the suction amount increases by about 0.03 cc when the real suction time is 0.1 seconds. Therefore, even an ink jet print head requiring a much higher suction pressure can be cleaned without a substantial increase in suction amount.

Thus, the present embodiment sets the real suction time between the opening of the charge valve and the subsequent opening of the cap at 0.1 seconds.

Further, if the "suction B" is selected for the suction step (2), even when the pump is continuously driven while the charge valve is open, the level of pressure reduction does not subsequently increase, resulting in no contribution to the removal of bubbles from the very small parts of the ink ejection nozzles. Accordingly, the pump is stopped before the charge valve is opened. This enables the suction amount to be controlled.

The suction step (2) is mainly intended to remove bubbles from the ink ejection nozzle section (the bubbling chamber 308, the ink introduction section 307 and the like) of the print head. This step is executed because even though the ink paths 302, the ink common liquid chamber 303 and the like in the print head are filled with ink during the suction step (1), not all the bubbles are removed from the very small parts of above ink ejection nozzles section, particularly the small-droplet nozzles. That is, the suction step (2) is the final suction for removing bubbles from the nozzle section without increasing the suction amount.

Selection of the cleaning 2 sets the total suction amount at about 0.38 cc (0.35 cc+0.03 cc), the maximum pressure for the suction in the suction step (1) at about −20 kPa, and the maximum pressure for the suction in the suction step (2) at about −35 kPa.

Figure 13:
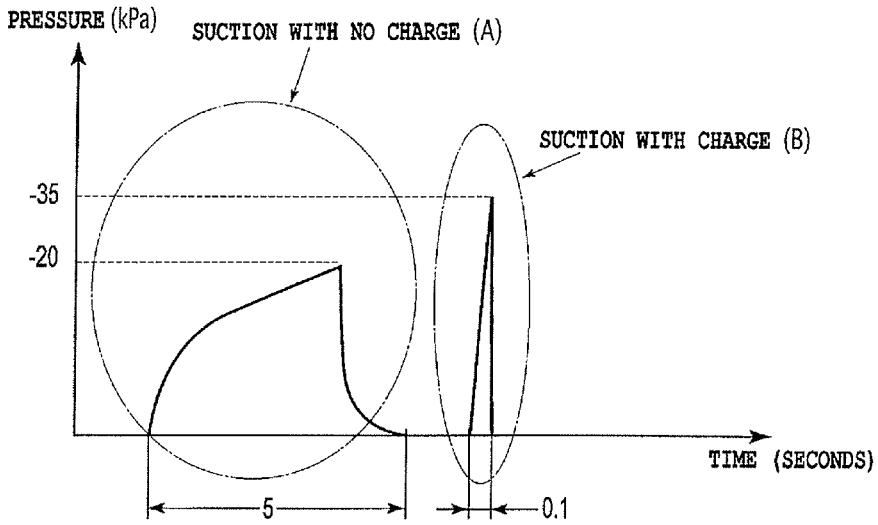
FIG. 13 is a graph showing suction time and suction pressure in accordance with the first embodiment of the present invention.

FIG. 13 is a diagram showing a pressure waveform observed when the print head is subjected to actual suction. The former half of the waveform indicates the suction A, which does not use any charge valve. The latter half of the waveform indicates the suction B, which uses the charge valve. The suction A has a peak pressure of about −20 kPa and a suction duration of about 5 seconds. The suction B has a peak pressure of −35 kPa. With the suction B, the time during which negative pressure is maintained after the charge valve is opened (the time elapsing until the cap is open to the atmosphere) is about 0.1 seconds.

Figure 14:
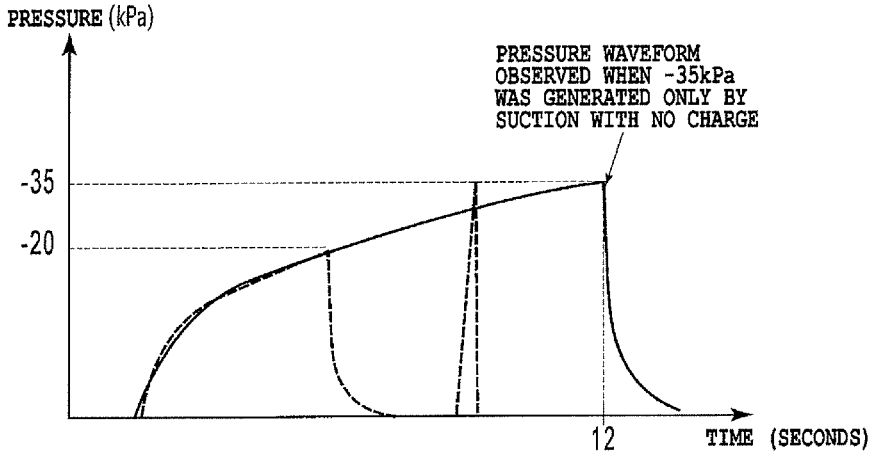
FIG. 14 is a graph showing the relationship between the suction time and suction pressure in a conventional example.

For comparison, FIG. 14 is a diagram showing a pressure waveform observed when suction for ink tank replacement is performed on the present ink jet print head in accordance with the conventional tube scheme. Increasing the suction pressure to −35 kPa by only the tube pump function requires a suction duration of about 12 seconds and a suction amount of about 0.65 cc.

Figure 15:
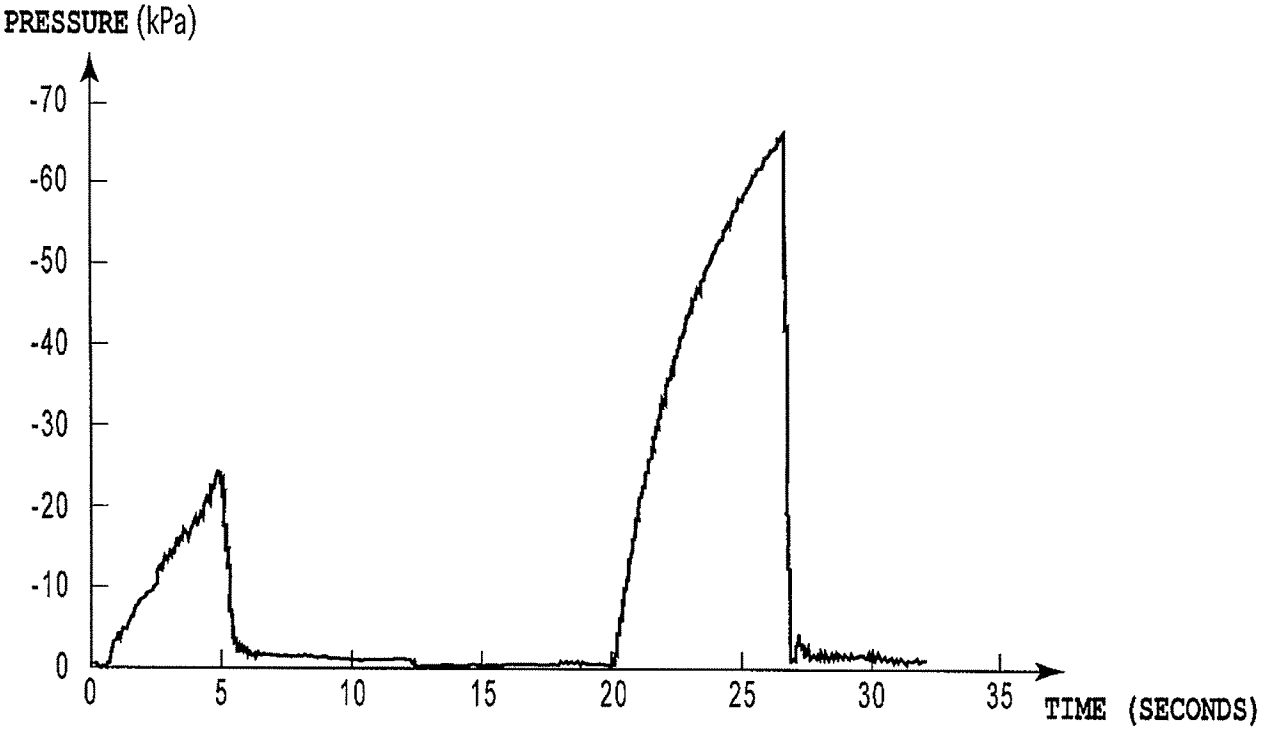
FIG. 15 is a graph showing the relationship between the suction time and suction pressure for suction performed near a pump in accordance with the first embodiment of the present invention.

FIG. 15 is a diagram showing a pressure waveform for the cleaning 2. In FIG. 15, the axis of ordinate indicates pressure, and the axis of abscissa indicates time. FIG. 15 is a plot of values obtained by measuring static negative pressure (negative pressure generated while no ink is flowing) at a position closer to the pump than the charge valve (the position closer to the pressure reduction chamber) during the cleaning 2. The former half of the waveform indicates the suction A, which does not use any charge valve. The latter half of the waveform indicates the suction B, which uses the charge valve. The suction A has a peak pressure of about −25 kPa and a suction duration of about 5 seconds. The suction B has a peak pressure of −65 kPa. With the suction B, accumulation of the charge pressure requires about 4 seconds.

FIGS. 15 and 13 indicate that the suction using the charge valve suffers a heavy loss of the charge pressure and the suction pressure. The loss is determined by the volume ratio of the volume V1 of the interior of the tube extending from the roller 12 to the charge valve 10, shown in FIG. 10 to a volume V2 equal to the volume V1 plus the volume of the recovery system extending from the valve 10 to the print head H1001 observed after the charge valve 10 is opened. Therefore, according to the present embodiment, the loss of the suction pressure can be reduced by disposing the charge valve as close to the print head H1001 as possible.

As described above, the suction recovery control using the charge valve enables an increase in suction pressure while reducing the impact on the suction amount. This makes it possible to generate a suction pressure required for the recovery operation for filling the ejection ports with ink and to remove bubbles from the ejection ports. Therefore, high printing reliability can be ensured.

Further, the suction amount during ink tank replacement is reduced from 0.65 cc to 0.38 cc, that is, to 58% of the initial amount. This enables a reduction in the sizes of members required to hold waste ink and thus in the size and cost of the printing apparatus.

The printing apparatus in accordance with the present embodiment has the nozzle lines with the different ejection amounts as shown in FIG. 5 or 6. Description will be given of effects exerted by simultaneously subjecting the nozzle lines with the different ejection amounts to suction.

On the basis of the Hagen-Poiseuille's general formula, the flow resistance of the nozzles is expressed as follows:

$$\Delta P = 128 L Q \eta / \pi D^4$$

$\eta$: ink viscosity (kgf*sec/m$^2$), L: tube length (m), Q: flow rate (m$^3$), D: tube diameter (m).

If $\eta$, L, and Q are assumed to be almost constant, the pressure loss in the ink ejection nozzle section is generally proportional to the 4th power of the diameter of the ejection port.

Thus, with a print head having a plurality of ink nozzle lines with different ink ejection amounts as in the case of the present embodiment, if the nozzle lines with the different ejection amounts are simultaneously subjected to suction, ink flows more easily from the nozzles with larger ejection ports. This prevents an increase in the suction pressure required to remove bubbles from the ink nozzles. Further, the ink nozzles with smaller ejection ports require a higher level of pressure reduction in order to remove bubbles, owing to a meniscus force. The suction pressure thus needs to be increased in order to achieve the required pressure.

Consequently, the present embodiment enables suction recovery without a substantial increase in suction amount even with the print head having the ink ejection nozzles with the different suction amounts and the suction pressure required to remove bubbles from ink nozzles for smaller droplets.

The suction shown in FIG. 14 took 12 seconds to generate an ink flow. On the other hand, the present embodiment took only 5 seconds to generate an ink flow. This enables a reduction in the load on the ink supply system, that is, the ink tanks, allowing the entry of bubbles from the supply system to be inhibited.

Although the present embodiment relates to the printing apparatus having the nozzle lines with the different suction amounts, the present invention is also applicable to a printing apparatus having nozzle lines with the same ejection amount. Besides the ink jet printing apparatus, the present invention is applicable to facsimile machines, copiers, word processors, and composite machines to which the ink jet printing apparatus is applied.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-236381, filed Aug. 31, 2006, which is hereby incorporated by reference herein in its entirety.

What is claimed is:

1. An ink jet printing apparatus for printing by using a print head having an ejection port surface in which ejection ports for ejecting ink are formed, said apparatus comprising:

a cap that covers the ejection port surface, said cap being switchable between a first condition, where an inside of said cap is in communication with air, and a second condition, where the inside of said cap is not in communication with air;

a pump configured to generate negative pressure in said cap;

a valve disposed between said cap and said pump and configured to switch between a first condition, where said cap and said pump are in communication with each other, and a second condition, where said cap and said pump are not in communication with each other; and a control unit for controlling said pump, said valve, and the condition of said cap, said control unit executing:

a first suction operation to suck ink from the print head by driving said pump with said cap in the second condition and said valve in the first condition, a second suction operation, after the first suction operation, to discharge ink remaining in said cap by driving said pump with said cap in the first condition and said valve in the first condition, and a third suction operation, after the second suction operation, to suck ink from the print head by driving said pump with said valve in the second condition and then switching said valve from the second condition to the first condition with said cap in the second condition.

2. The ink jet printing apparatus according to claim 1, wherein said valve is located closer to said cap than to a middle position between said cap and a portion of a tube pressed by said pump.

3. The ink jet printing apparatus according to claim 1, wherein an absolute value of the negative pressure generated by the third suction operation is greater than an absolute value of the negative pressure generated by the first suction operation.

4. The ink jet printing apparatus according to claim 1, wherein an operating time of the third suction operation is shorter than an operating time of the first suction operation.

5. A suction method for an ink jet printing apparatus including a print head having an ejection port surface in which ejection ports for ejecting ink are formed, a cap that covers the ejection port surface and that is switchable between a first condition, where an inside of the cap is in communication with air, and a second condition, where the inside of the cap is not in communication with air, a pump for generating negative pressure in the cap, and a valve disposed between the cap and the pump, wherein the valve is configured to switch between a first condition, where the cap and the pump are in communication with each other, and a second condition, where the cap and the pump are not in communication with each other, said method comprising:

a first suction step of driving the pump with the valve in the first condition and the cap in the second condition;

a second suction step, after the first suction step, of driving the pump with the cap in the first condition and the valve in the first condition to discharge ink remaining in the cap; and a third suction step, after the second suction step, of driving the pump with the valve in the second condition and then switching the valve from the second condition to the first condition with the cap in the second condition.

6. The ink jet printing apparatus according to claim 1, wherein the control unit switches said valve from the second condition to the first condition during the third suction operation after stopping the driving of the pump.

7. The suction method according to claim 5, wherein the third suction step switches the valve to be in the first condition after stopping the driving of the pump.

8. The ink jet printing apparatus according to claim 1, wherein the control unit sequentially executes the first and second suction operations N times, where N is an integer greater than or equal to one, immediately followed by executing the third suction operations M times, where M is an integer greater than or equal to one.

9. The ink jet printing apparatus according to claim 8, wherein N is greater than one.

10. The ink jet printing apparatus according to claim 9, wherein N is equal to two.

11. The ink jet printing apparatus according to claim 8, wherein M is greater than one.

12. The ink jet printing apparatus according to claim 11, wherein M is equal to two.

13. The suction method according to claim 5, wherein in one cleaning operation, the first suction operation and the second suction operation are sequentially performed N times, where N is an integer greater than or equal to one, immediately followed by performing the third suction operations M times, where M is an integer greater than or equal to one.

14. The suction method according to claim 13, wherein N is greater than one.

15. The suction method according to claim 14, wherein N is equal to two.

16. The suction method according to claim 13, wherein M is greater than one.

17. The suction method according to claim 16, wherein M is equal to two.

18. The ink jet printing apparatus according to claim 1, wherein said cap includes a second valve to switch between the first condition of the cap and the second condition of the cap.

19. The ink jet printing apparatus according to claim 1, wherein the control unit places the cap in the first condition by separating the cap from the ejection port surface.

20. The suction method according to claim 5, wherein, in the second suction step, the cap is switched between the first and second condition by switching a second valve.

21. The suction method according to claim 5, wherein the cap is switched from the second to the first condition by separating the cap from the ejection port surface.

* * * * *